US005293674A

United States Patent [19]

Hendrikx

[11] Patent Number: 5,293,674

[45] Date of Patent: Mar. 15, 1994

[54] SECURITY CLIP TO DISCOURAGE THEFT AND A PROCEDURE FOR MANUFACTURING SUCH A SECURITY CLIP

[76] Inventor: Jacobus G. M. Hendrikx, Diepenbrocklaan 23, 5242 HB Rosmalen, Netherlands

[21] Appl. No.: 853,747

[22] PCT Filed: May 30, 1991

[86] PCT No.: PCT/NL91/00088

§ 371 Date: Jun. 10, 1992

§ 102(e) Date: Jun. 10, 1992

[87] PCT Pub. No.: WO91/19874

PCT Pub. Date: Dec. 26, 1991

[30] Foreign Application Priority Data

Jun. 13, 1990 [NL] Netherlands ..... 9001337

[51] Int. Cl.[5] ..... G08B 13/00

[52] U.S. Cl. ..... 24/704.1; 24/707.6; 340/568

[58] Field of Search ..... 24/704.1, 704.2, 706.8, 24/707.6, 707.1, 707.5; 70/57.1; 340/568, 691, 572

[56] References Cited

U.S. PATENT DOCUMENTS 3,604,958 9/1971 Palini ..... 340/568
3,858,280 1/1975 Martens ..... 24/704.1
4,253,084 2/1981 Topputo ..... 340/568
4,523,356 6/1985 Charlot, Jr. ..... 24/707.6
4,670,950 6/1987 Wisecup et al. .
4,698,620 10/1987 Marshall .
4,993,245 2/1991 Ott ..... 24/704.1
5,072,213 12/1991 Close ..... 340/568

FOREIGN PATENT DOCUMENTS 2539035 3/1977 Fed. Rep. of Germany .

*Primary Examiner*—Victor N. Sakran
*Attorney, Agent, or Firm*—Young & Thompson

[57] ABSTRACT

Security clip for discouraging theft of goods, comprising an ink-filled reservoir (10) having an outer circumference, a pin (5) and a pin-receiving member forming part of an electronic security system. The pin (5) is connected to the reservoir (10), and the reservoir has a rupture edge (6) which is situated between the pin and the circumference of the reservoir (10). The reservoir (10) consists of a dish (1) and a covering plate (2) which has a sloshing edge (7) that extends down into the dish (1). The outside (8) of the sloshing edge and the inside (9) of the dish (1) cooperate in an airtight way such that upon pushing the covering plate (2) towards the dish (1) a pressure increase is created within the reservoir (10). Thus, when the rupture edge is ruptured, the ink is distributed by this over-pressure.

9 Claims, 1 Drawing Sheet

Figure 1:
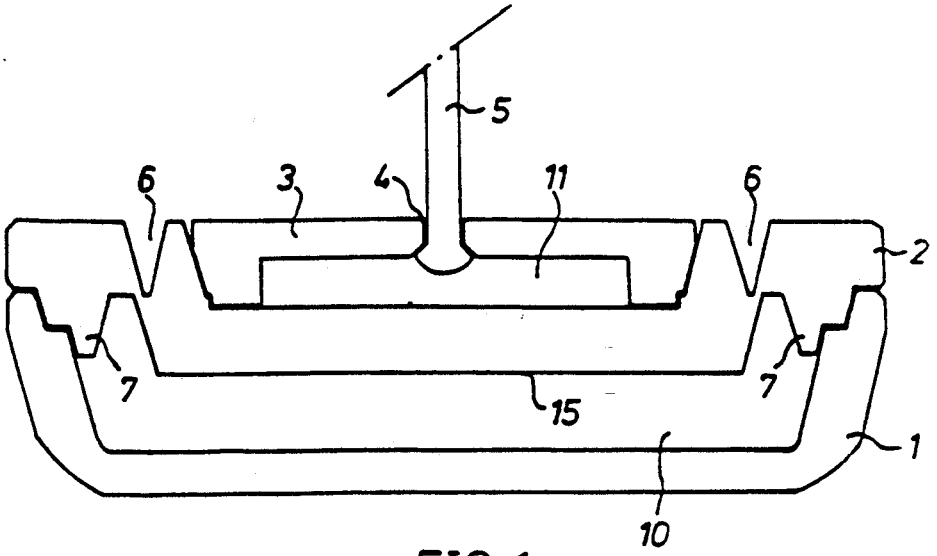

SECURITY CLIP TO DISCOURAGE THEFT AND A PROCEDURE FOR MANUFACTURING SUCH A SECURITY CLIP

The invention concerns a security clip which is intended to discourage theft of the goods which are to be protected. This clip contains a reservoir, filled with ink, which has a rupture edge. The invention further relates to a process for the manufacture of such a security clip.

Such security clips are known from British patent application 2.075.116, in which the colour clip (brand name) has ampoules filled with ink. If the clip is inexpertly broken open then the ampoules filled with ink also break, releasing the ink which then flows over the item of clothing or suchlike thus protected, so rendering the goods unusable. When the clip is used judiciously, as described in the cited British patent application, the clip can be removed without breaking the glass ampoules. The clip can subsequently be re-used. A clip, as brought onto the market and working on the principle as described in the British patent application, has weakening points or rupture edges through which the clip breaks when inexpertly opened.

Most security system currently used in the prevention of theft of certain goods, particularly clothing, are electronic security systems. Here a clip is affixed to the goods to be protected in such a way that it can only be removed (inexpertly) from the goods by destroying those goods. If someone attempts to leave the shop with goods to which the clip is still attached, then an alarm signal will be generated at the exit thus enabling the person carrying the goods to be apprehended. Such electronic security system have been know for a long time now. They are described for example, in Dutch patent application 7306201, in U.S. Pat. No. 4,523,356 and in Dutch patent application 8800367. Furthermore, there is a security clip on the market under this U.S. Patent; which security clip can provide electronic protection but which also has ampoules filled with ink.

Not only are the presently-known security clips with ink-filled ampoules relatively expensive but many shops are also already equipped with electronic security systems. This is the reason behind the current search for a cheaper security clip (based upon the principle of ink release upon illegal removal of the security clip from the goods to be protected) which not only works effectively but which can also be used with electronic surveillance systems.

Such a security clip has now been developed. The characteristic features of the security clip mentioned in the introduction are a reservoir, formed by a dish and a covering plate. The clip also has a pin, which can make up part of an electronic security system.

The pin fitted into the security clip (as in the invention) could thus be the type of pin recorded (as 16), for example, in Dutch patent application 7306201 or as recorded (as 10) in Dutch patent application 8800367. It will, however, be clear that the security clip (as in the invention) is not restricted to any particular version of the pin. The pin to be used will depend upon the type of electronic security system used, whereby the pin already in use can be incorporated into the security clip (as in the invention). Shop which, as yet, have no electronic security system will of course have a free choice regarding the type of pin which will make up part of the electronic security system.

The invention will be further elucidated by means of the following description, in which reference is made to the enclosed drawing in which:

FIG. 1 gives a cross-sectional view of the security clip (as in the invention).

Figure 4:
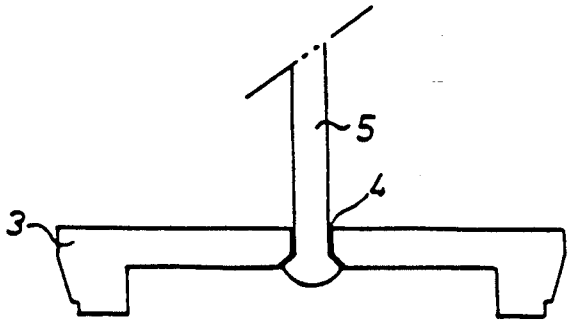
Figure 3:
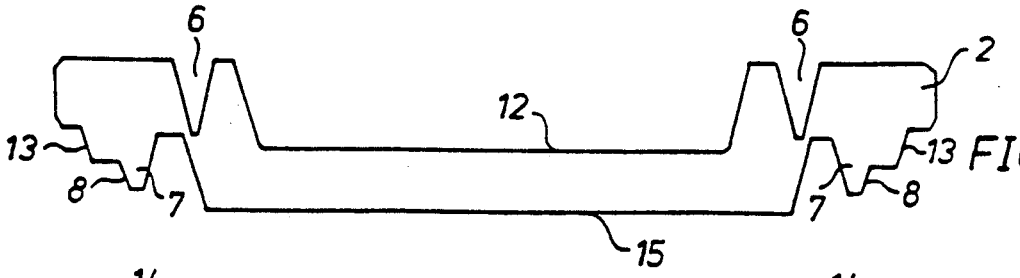
Figure 2:
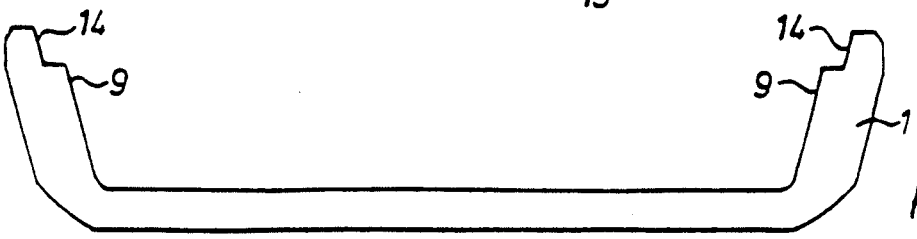

FIGS. 2, 3 and 4 show in cross-section the respective parts from which (essentially) the security clip is constructed, namely the dish (1), covering plate (2) and small plate (3) with a pin (5).

The security clip (as in the invention) is shown in FIG. 1, in assembled form and with the various parts diagrammatically illustrated. The security clip consists of a dish which should preferably be constructed of transparent plastic, such that the ink introduced into reservoir (10) can be clearly seen. The ink to be used in such a security clip is a non-washable ink which solidifies only at a (relatively) very low temperature. Such types of ink are known in the trade. These can be obtained, for example, from Inkfabriek Twello at Deventer Netherland. The second component of the colour clip (as in the invention) is covering plate (2), as shown in FIG. 3. This covering plate completely seals the ink reservoir (10) and ensures that, when the security clip is inexpertly used, the covering plate will tear, thus releasing the ink. In order to make the covering plate (2) tear, a tearing edge or rupture edge (6) is fitted. In addition the covering plate (2) is fitted with a so-called sloshing edge (7), which has two functions. The first function of the sloshing edge is to ensure that, when the covering plate (2) is laid on the dish (1) filled with ink, the whole assembly can be moved without any ink reaching the edge near part (14) of the dish (1). This is because the upper part (14) is used for the fastening between the dish (1) and the covering plate (2), which fastening should preferably be carried out by ultrasonic welding. This welding process must not be disrupted by the presence of ink. By manufacturing the covering plate (2) with a sloshing edge (7) ink is prevented from reaching the upper part (14) when the reservoir is moved prior to carrying out ultrasonic welding. The second function of the sloshing edge (7) has to do with the fact that, if the security clip is to function well, the ink in the reservoir (10) should be under a slight over-pressure such that, when the security clip is inexpertly opened the ink sprays out of the security clip. This over-pressure can be achieved by first obtaining an air-tight seal when placing the covering plate (2) onto the ink-filled dish (1). Next the covering plate (2) is pushed further into the reservoir (10) whereby the lower side (15) of the covering plate, through a movement directed into the reservoir (10), will create an over-pressure in the reservoir (10). Next ultrasonic welding is carried out between the upper part (14) of the dish (1) and the outer wall (13) of the covering plate (2).

In order to improve the bonding between the various parts, namely dish (1) and covering plate (2), both parts can be provided with profiled surfaces which clasp together instead of the forms with a smooth design shown in the drawing. This also applies to the junction between the plate (3) with the pin (5) in the cavity (11) on the upper side (12) of the covering plate (2). As illustrated in FIG. 1, the next part of the security clip (as in the invention) is the plate (3) with the pin (5) fitted into it, as shown in FIG. 4. The pin (5), which constitutes part of the electronic security system, is fixed into the security clip by sticking the pin through the opening (4) in plate (3) and then by fitting this plate (3) into the cavity (11) on the upper side (12) of the covering plate (2). This fastening can also be carried out using ultrasonic welding, although it is possible to use adhesive for all the other fastenings, for example. Once the plate (3) has been fastened into the covering plate (2) the pin (5) can turn freely in the cavity (4). The ability of the pin (5) to turn freely increases security, since it would otherwise be possible for force to be applied to the pin (5) whereby the security clip would not function optimally.

The security clip (as in the invention) can prevent the removal of an electronic security clip from an item of clothing or suchlike as a prelude to the illegal removal of that item of clothing from the shop. The double protection which can presently be obtained with the security clip (as in the invention) will discourage removal of the electronic security system in the shop, since an attempt to remove the electronic security system will result in the ink reservoir breaking open thus rendering the goods unusable. Because of this the removal of the electronic security clip will be discouraged now that this electronic security clip has an ink security system. Legal removal of the security clip (as in the invention) will take plate in a shop, where the security clip will be removed from the item of clothing at the cash point in the same way as electronic security clips are presently removed. By this means the clip is released from the item of clothing as show in FIG. 1 and can once more be incorporated into an electronic security clip and fixed to clothing, or other goods which are to be protected.

The procedure for manufacturing a security clip (as in the invention) is as follows:

a) the pin (5) is fitted into the plate (3) which is fastened into the cavity (11) of the covering plate (2),b) the dish (1) is filled with ink, c) the covering plate (2) is fitted to the dish (1), sealing it off with an air-tight seal, d) the covering plate (2) is pressed such that the lower side (15) of the covering plate (2) is pushed further into the reservoir (10) creating an over-pressure in the reservoir (10), e) the covering plate (2) is attached to the reservoir (10), by ultrasonic welding for example.

It will be clear that it is also possible to carry out step a), as shown above, after step e) and to start the procedure at step b).

What is claimed is:

1. Security clip for discouraging theft of goods, comprising an ink-filled reservoir (10) having an outer circumference, a pin (5) and a pin-receiving member forming part of an electronic security system, the pin (5) being connected to the reservoir (10), and the reservoir having a rupture edge (6) which is situated between the pin and said circumference of the reservoir (10).

2. Security clip according to claim 1, in which the ink in the reservoir (10) is at a pressure which is higher than the ambient pressure.

3. Security clip according to claim 1, in which the reservoir (10) consists of a dish (1) and a covering plate (2) which has a sloshing edge (7) that extends down into the dish (1).

4. Security clip according to claim 3, in which the outside (8) of the sloshing edge and the inside (9) of the dish (1) cooperate in an airtight way such that upon pushing the covering plate (2) towards the dish (1) a pressure increase is created within the reservoir (10).

5. Security clip according to claim 3, in which the pin (5) is connected to the covering plate (2), and the rupture edge (6) is provided in said covering plate (2).

6. Security clip according to claim 5, in which the pin (5) is rotatably connected to the covering plate (2).

7. Security clip according to claim 5, in which the pin (5) is fitted into a plate (3) which is fastened in a cavity (11) of the covering plate (2), which cavity (11) is surrounded by the rupture edge (6).

8. Security clip according to claim 3, in which the outer wall (13) of the covering plate (2) and the upper part (14) of the dish fit together in such a way that they are ultrasonically weldable.

9. Process for manufacturing a security clip, comprising the steps of:

a) passing a pin (5) through an opening (4) in a plate (3), b) fastening plate (3) into a cavity (11) in a covering plate (2), c) filling a dish (1) with ink, d) fitting the covering plate (2) into the dish (1) in such a way that an airtight seal is formed, e) pushing the covering plate (2) into the dish whilst maintaining the airtight seal and thereby creating a higher pressure in the dish (1), and f) fastening the covering plate (2) hermetically sealed on the dish (1).

* * * * *